United States Patent [19]

Kennedy, Jr. et al.

[11] Patent Number: 4,542,822

[45] Date of Patent: Sep. 24, 1985

[54] DISPLAY PACKAGE

[75] Inventors: Robert J. Kennedy, Jr.; Kendall S. Smith, II; Gregory N. Brown, all of Lafayette, Ind.

[73] Assignee: Ristance Corporation, Mishawaka, Ind.

[21] Appl. No.: 170,856

[22] Filed: Jul. 21, 1980

[51] Int. Cl.[4] ..... B65D 65/16; B65D 85/30; B65D 81/16

[52] U.S. Cl. ..... 206/45.33; 206/523

[58] Field of Search ..... 206/45.33, 523, 521, 206/45.34, 45.14

[56] References Cited

U.S. PATENT DOCUMENTS 3,451,536 6/1969 O'Leary et al. ..... 206/45.33

3,493,107 2/1970 Markey ..... 206/45.33

*Primary Examiner*—William T. Dixson, Jr.

*Attorney, Agent, or Firm*—James D. Hall

[57] ABSTRACT

A display package for merchandise in which an inner box has a cavity formed in it for the storage of the merchandise and a cover fitted partially about the box.

3 Claims, 4 Drawing Figures

DISPLAY PACKAGE

SUMMARY OF THE INVENTION

This invention relates to a display package for small merchandise items.

In the packaging and merchandising of small products it is desirable to have a package that will provide both protection of the products from crushing and adequately allow an attractive visual display of the products. The present invention is of a multiple part construction including an inner box and an outer cover. The inner box is generally solid with a cavity formed in it to define a bottom wall having an opening therein. An outer cover is fitted under the box bottom wall and its opening and partially over the box to expose the cavity at its opening. The products are placed within the cavity. The package is then preferably enveloped with a clear plastic covering. Accordingly, it is an object of this invention to provide a durable display package.

Another object of this invention is to provide a means of packaging merchandise which is visually attractive.

Other objects will become apparent upon a further reading of the following description.

DESCRIPTION OF THE PREFERRED EMBODIMENT

Figure 1:
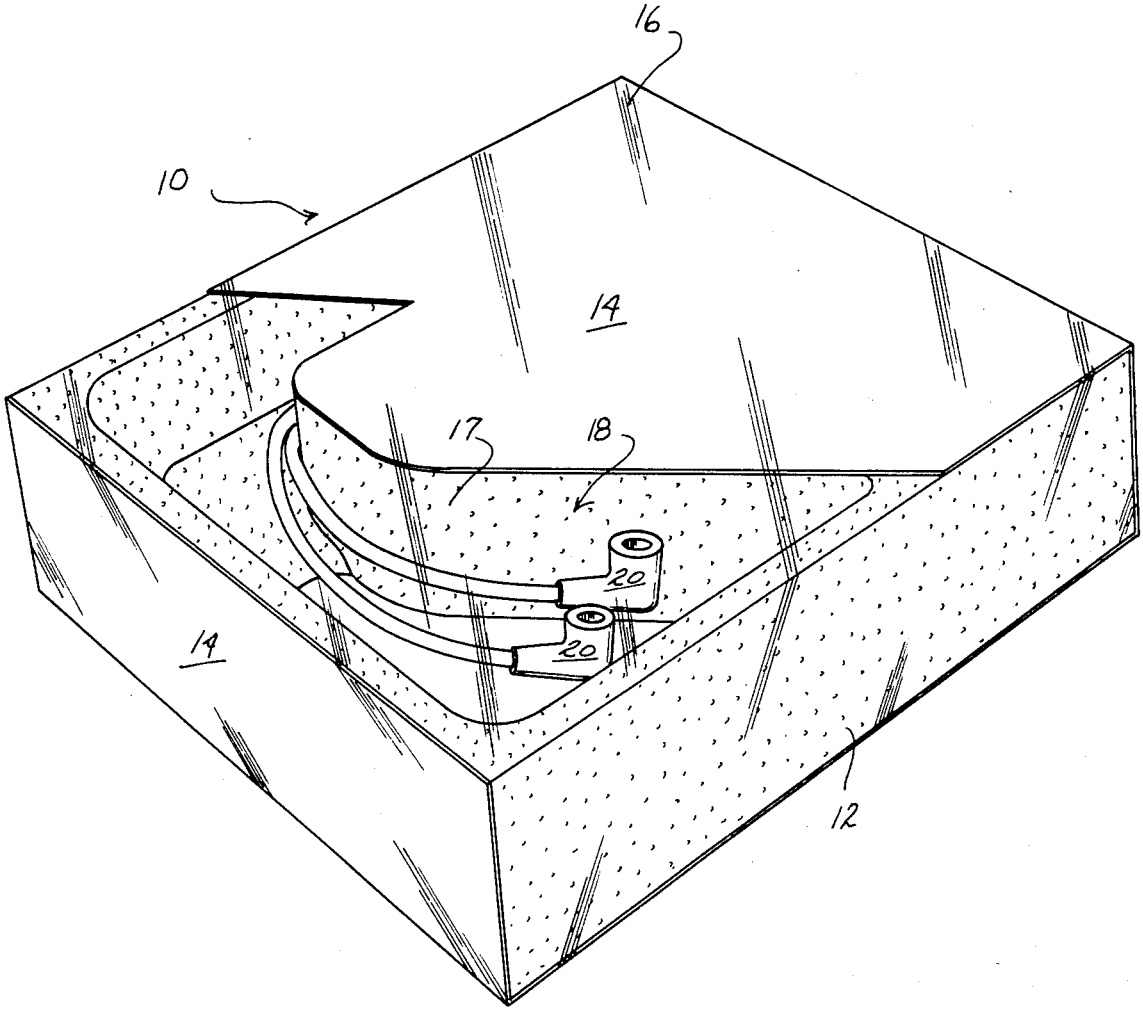
FIG. 1 is a perspective view of the display package.
Figure 2:
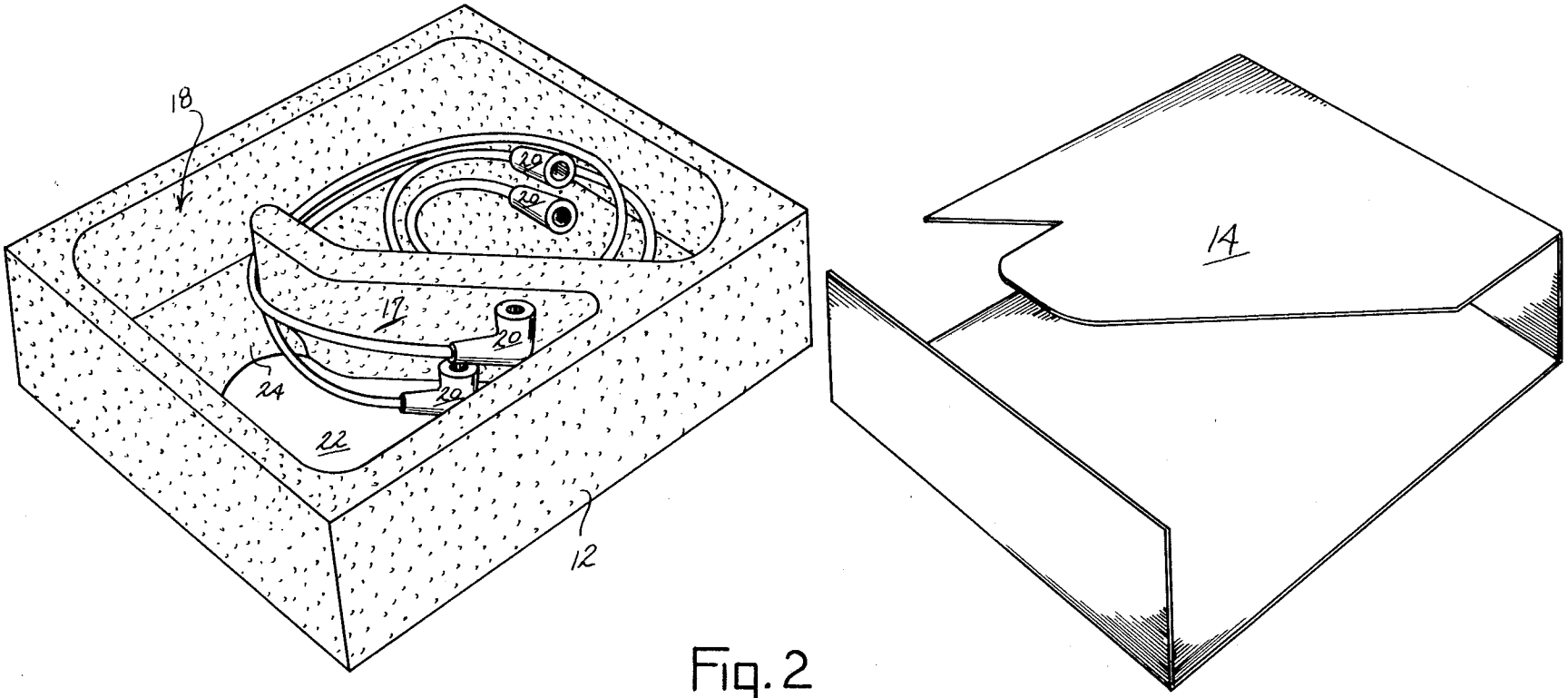
FIG. 2 is an exploded perspective view of the components of the package.
Figure 4:
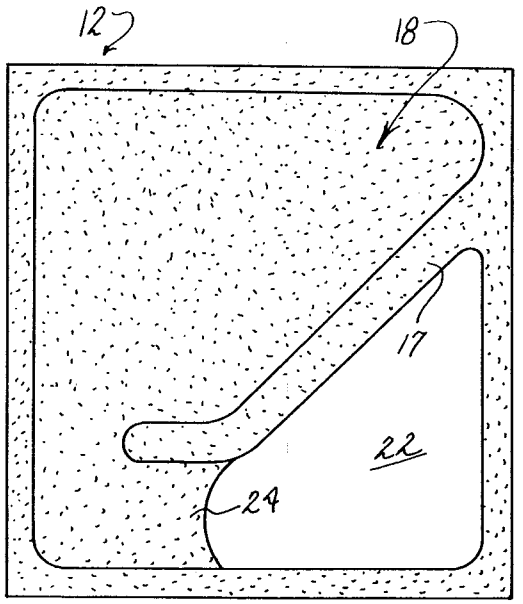
FIG. 4 is a top plan view of the inner box.
Figure 3:
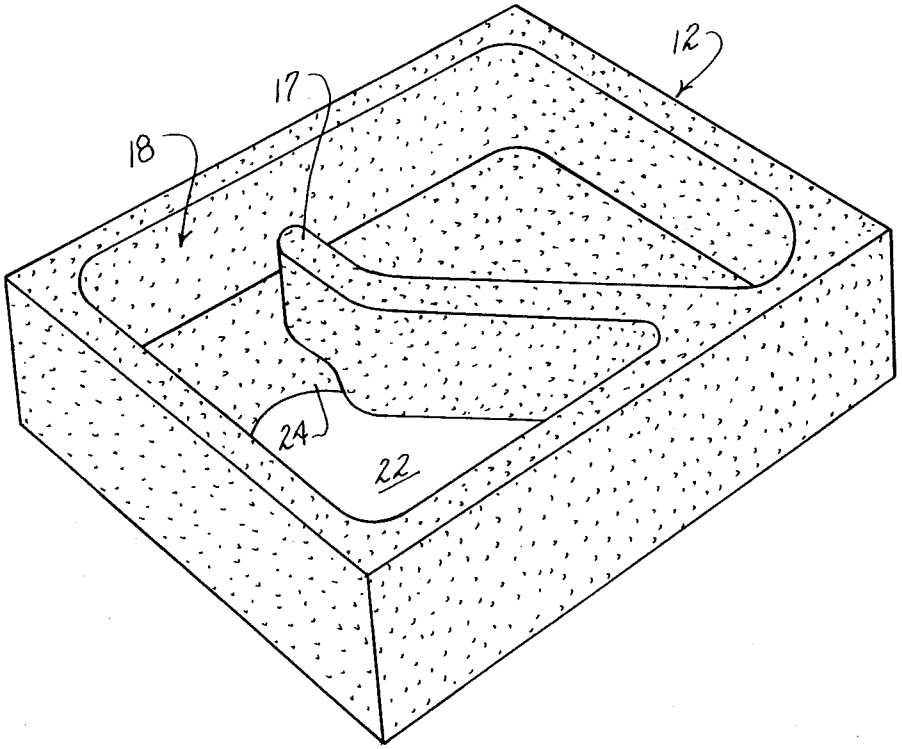
FIG. 3 is a perspective view of the inner box of the package.

The preferred embodiment illustrated is not intended to be exhaustive or to limit the invention to the precise form disclosed. It is chosen and described in order to best explain the principles of the invention and its application and practical use to thereby enable others skilled in the art to best utilize the invention.

Referring to the figures, display package 10 is composed of an inner box 12 and an outer cover 14. A transparent jacket 16 envelopes the assembled box and cover. Inner box 12 has a cavity 18 formed therein. A window or opening 22 is formed in the lower wall 24 of box 12. A stanchion or partition 17, depending upon the type of merchandise carried within package 10, projects from wall 24 next to opening 22. Merchandise 20, in this illustration automobile ignition wires, is stored within cavity 18, extending around partition 17. Cover 14 extends under the lower side face of box 12, wherein it supports merchandise 20 at opening 22 in the box, and over a portion of the box upperside face to partition 17, where in turn it is supported above the merchandise by the partition.

Box 12 is preferably formed of styrofoam or a similar material which is crush resistant, light weight, and easily formed. Outer cover 14 is non-transparent and may be colored in contrast to box 12 to visually emphasize merchandise 20 at box opening 22. Transparent jacket 16 is fitted and sealed about box 12 and cover 14 to protect the merchandise from dust, as well as to secure the merchandise within the box. It is contemplated that in some constructions of this invention, jacket 16 may be omitted from the display package with cover 14 being glued to box 12.

It is understood that the invention is not to be limited to the preceding description but is to be interpreted within the scope of the appended claims.

What we claim is:

1. A display package including an inner box, said box being defined by opposite upper and lower side faces and a peripheral edge extending about said side faces, a cavity formed in said upper side face to receive merchandise, an opening formed in part of said lower side face in communication with a portion only of said cavity, with the remainder of said box at its lower face forming a wall means for supporting said merchandise, a removable cover fitting about said box, said cover underlying said lower face at its opening therein and overlying said upper face over said wall means with said lower face opening and underlying cover at the opening being exposed, whereby said merchandise will overlie said cover at said lower face opening.

2. The display package of claim 1 wherein said box includes means projecting upwardly from said box wall means adjacent said opening for supporting said cover above said merchandise.

3. The display package of claim 2 having a transparent jacket covering said cover and box, said cover being non-transparent.

* * * * *